US005148891A

United States Patent [19]

McConnell

[11] Patent Number: 5,148,891

[45] Date of Patent: Sep. 22, 1992

[54] LADDER EXTENSION STEP APPARATUS

[76] Inventor: Karen R. McConnell, 616 Liberty, Beloit, Wis. 53511

[21] Appl. No.: 694,769

[22] Filed: May 2, 1991

[51] Int. Cl.[5] ..... E06C 7/14; E06C 7/16

[52] U.S. Cl. ..... 182/120; 182/228

[58] Field of Search ..... 182/120, 121, 122, 228; 248/210, 238

[56] References Cited

U.S. PATENT DOCUMENTS

| | | | |
|---|---|---|---|
| 1,285,817 | 11/1918 | Sklar | 182/120 |
| 2,066,108 | 12/1936 | Hedges | 182/120 |
| 2,308,180 | 1/1943 | Larsen | 248/238 |
| 2,730,412 | 1/1956 | Yoder | 182/120 |
| 3,312,441 | 4/1967 | Molenda | 248/210 |
| 3,915,475 | 10/1975 | Casella | 182/120 |
| 4,300,740 | 11/1981 | Killian | 248/238 |

*Primary Examiner*—Reinaldo P. Machado
*Attorney, Agent, or Firm*—Leon Gilden

[57] ABSTRACT

A ladder extension member is arranged for securement to an associated ladder step of an associated ladder, wherein the organization is dismounted relative to the ladder step for resecurement thereto to provide an extension step. The extension step includes a plurality of "J" shaped support members mounting a planar support web fixedly therebetween, wherein the spaced "J" shaped support members permit capturing of an associated ladder step between the support web and a cavity defined by the "J" shaped support members. A plurality of spaced bottom plates are arranged with slots to effect selective capturing of the associated ladder step therewithin, or reciprocatable to a rear position to permit removal of the organization relative to the ladder step for reorientation of the ladder step thereto.

3 Claims, 4 Drawing Sheets

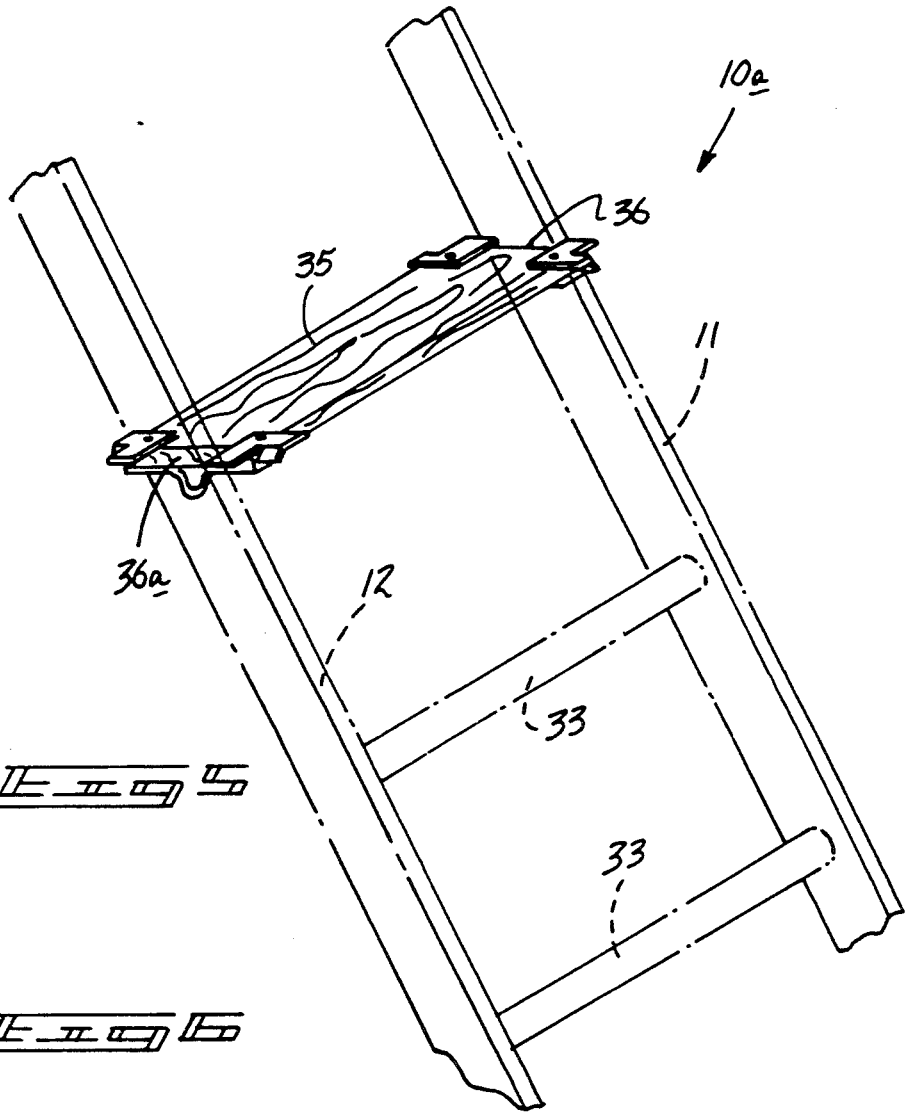
Fig 5
Fig 6
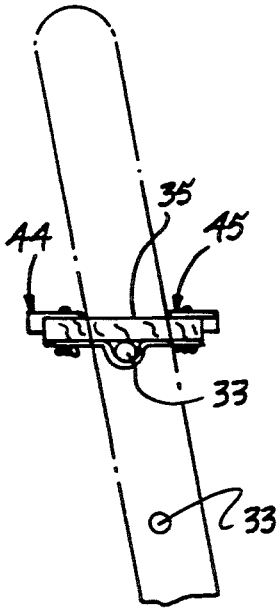

31a
31
47
44
50
48
49
46
43
48
45
47
46
36a
49
43
42
35
40
41
37
39
32

LADDER EXTENSION STEP APPARATUS

BACKGROUND OF THE INVENTION

1. Field of the Invention

The field of invention relates to ladder accessory apparatus, and more particularly pertains to a new and improved ladder extension step apparatus wherein the same is arranged for mounting relative to an associated ladder step for providing an enlarged step area for use by an individual for enhanced stability in use of the organization.

2. Description of the Prior Art

Ladder accessories of various types have been utilized with conventional step ladders for ease of use of the organization relative to various tasks. It is understood that in the use of such step ladder organizations, the compact structure of such a step ladder dictates ladder steps of relatively limited width defined by the predetermined widths of associated ladder legs mounting the ladder steps therebetween, wherein the instant invention sets forth an organization to provide an enlarged step area for use by an individual with a step ladder type structure.

Examples of prior art ladder accessories may be found and exemplified in U.S. Pat. No. 4,222,541 Cillis wherein a ladder tray support attachment includes a support tray with spaced brackets for mounting to a side rail or leg of an associated ladder.

U.S. Pat. No. 4,316,524 to Lapeyre sets forth a ladder structure utilizing a plurality of steps of various sizes, with a first size positioned laterally relative to a second size of ladder steps.

U.S. Pat. No. 4,318,523 Weatherly sets forth a support device mounted for use with hollow rung ladders mounted to studs directed within the hollow rung ladders for providing a support organization for use with various components, such as tools, paint materials, and the like.

As such, it may be appreciated that there continues to be a need for a new and improved ladder extension step apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of ladder apparatus now present in the prior art, the present invention provides a ladder extension step apparatus wherein the same is arranged for selective mounting exteriorly of ladder steps of an associated ladder arrangement for enhanced support area for use by an individual. As such, the general purpose of the present invention, which will be described subsequently in greater detail, is to provide a new and improved ladder extension step apparatus which has all the advantages of the prior art ladder apparatus and none of the disadvantages.

To attain this, the present invention provides a ladder extension member arranged for securement to an associated ladder step of an associated ladder, wherein the organization is dismounted relative to the ladder step for resecurement thereto to provide an extension step. The extension step includes a plurality of "J" shaped support members mounting a planar support web fixedly therebetween, wherein the spaced "J" shaped support members permit capturing of an associated ladder step between the support web and a cavity defined by the "J" shaped support members. A plurality of spaced bottom plates are arranged with slots to effect selective capturing of the associated ladder step therewithin, or reciprocatable to a rear position to permit removal of the organization relative to the ladder step for reorientation of the ladder step thereto. A further unit of the organization includes a plurality of "U" shaped bottom plates, with a step plate mounted thereon, with the step plate including a plurality of "L" shaped bracket members, wherein each bracket member includes a downwardly depending clamping jaw flange, wherein spaced pairs of clamping jaw flanges capture associated ladder legs therebetween to stabilize the unit on a ladder with cylindrical steps formed thereon.

My invention resides not in any one of these features per se, but rather in the particular combination of all of them herein disclosed and claimed and it is distinguished from the prior art in this particular combination of all of its structures for the function specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ladder extension step apparatus which has all the advantages of the prior art ladder apparatus and none of the disadvantages.

It is another object of the present invention to provide a new and improved ladder extension step apparatus which may be easily and efficiently manufactured and marketed.

It is further object of the present invention to provide a new and improved ladder extension step apparatus which is of a durable and reliable construction.

An even further object of the present invention is to provide a new and improved ladder extension step apparatus which is susceptible of a low cost of manufacture with regard to both materials and labor, and which accordingly is then susceptible of low prices of sale to the consuming public, thereby making such ladder extension step apparatus economically available to the buying public.

Still yet another object of the present invention is to provide a new and improved ladder extension step apparatus which provides in the apparatus and methods of the prior art some of the advantages thereof, while simultaneously overcoming some of the disadvantages normally associated therewith.

Still another object of the present invention is to provide a new and improved ladder extension step apparatus wherein the same sets forth a compact organization arrange for retrofit relative to an associated ladder organization, wherein the apparatus provides for an enlarged support area for a step for use by an individual.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an isometric illustration of a modification of the instant invention.

FIG. 6 is an orthographic side view of the modificaton of the instant invention.

DESCRIPTION OF THE PREFERRED EMBODIMENT

Figure 1:
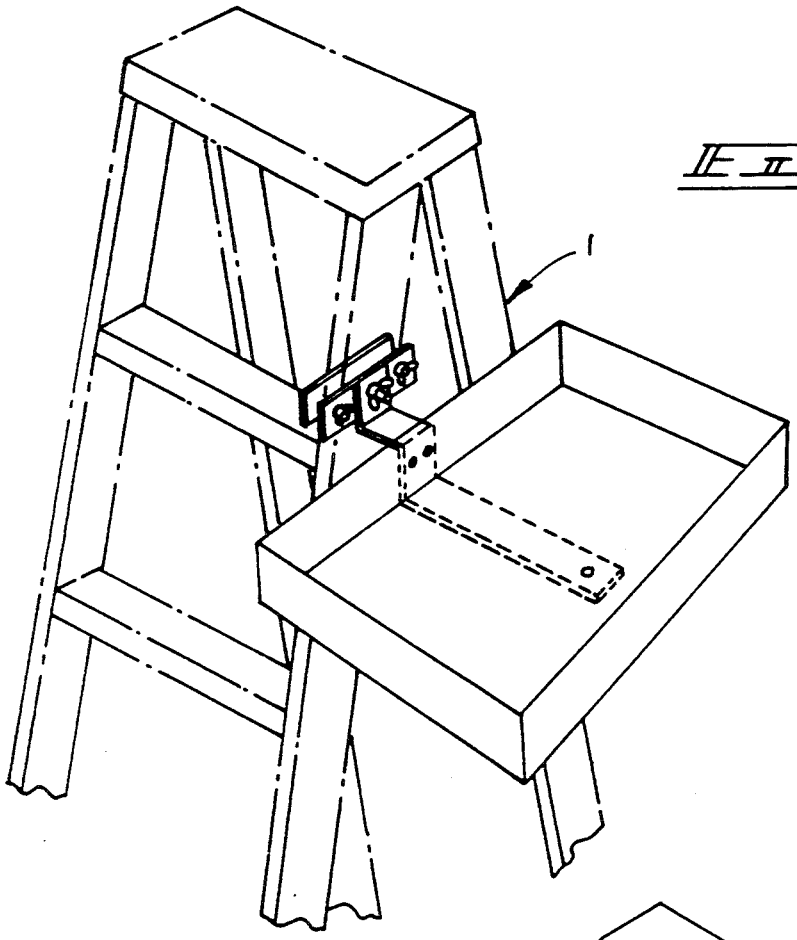
FIG 1 PRIOR ART
FIG. 1 is an isometric illustration of a prior art ladder accessory apparatus.

With reference now to the drawings, and in particular to FIGS. 3–7 thereof, a new and improved ladder extension step apparatus embodying the principles and concepts of the present invention and generally designated by the reference numerals 10 and 10*a* will be described.

Figure 4:
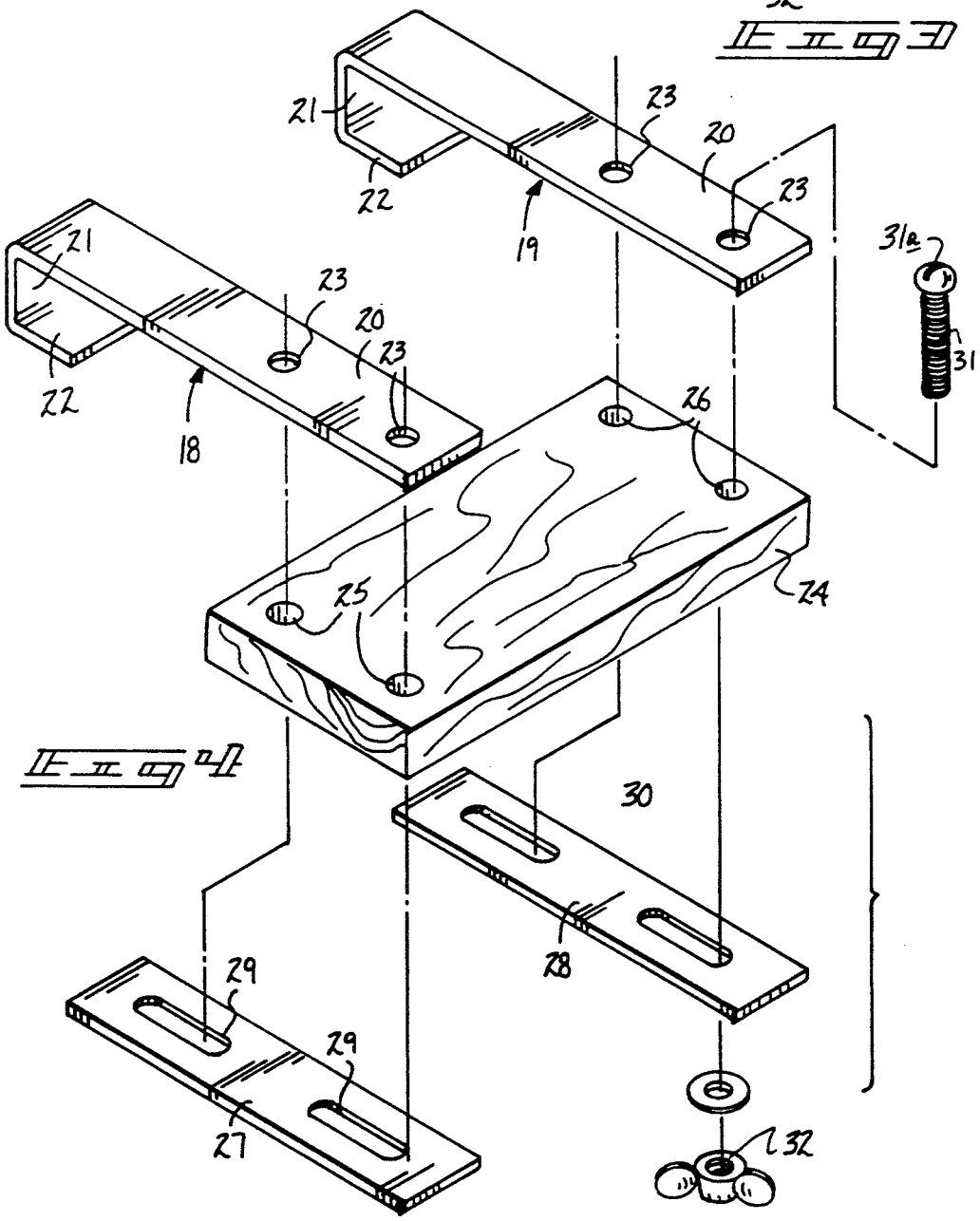
FIG. 4 is an isometric exploded view of the instant invention.

More specifically, the ladder extension step apparatus 10 of the instant invention essentially comprises a ladder assembly, including a forward right ladder leg 11 spaced from a forward left ladder leg 12. The forward right and left ladder legs 11 and 12 mount a series of spaced parallel planar ladder steps 15 orthogonally therebetween, with the ladder steps 15 arranged in a parallel spaced relationship, in a manner as illustrated in FIG. 1 for example. The ladder assembly includes a rear right ladder leg 13 and a rear left ladder leg 14 providing stability to the organization, wherein the ladder legs are mounted to a ladder top plate 16. The extension assembly 17 of the instant invention is mounted to one of the ladder steps 15 that includes spaced parallel support members defined by a right "J" shaped top support member 18 spaced from and parallel a left "J" shaped top support member 19. Each of the "J" shaped top support members 18 and 19 are formed by a first plate web 20 defined by a first length orthogonally mounted to a second plate web 21 defined by a second length, wherein the second length is substantially equal to a first height defined by each of the planar ladder steps 15. The planar ladder steps 15 are further defined by a first width measured parallel to each of the ladder legs 11 and 12. The second plate web 21 is then orthogonally mounted to a third plate web 22 defined by a third length, wherein the third length is less than that of the first width defined by each of the planar ladder steps 15, wherein the second and third plate webs 21 and 22 are define an "L" shaped bracket to receive a forward edge of each associated support web 24, wherein the third plate web 22 is arranged below and parallel the first plate web 20 and defines the third length substantially less than the first length. Each of the first plate webs 20 includes a plurality of spaced circular apertures directed therethrough defined by a predetermined spacing therebetween. The planar support web 24 includes a plurality of support web openings defined by respective right and left support web openings 25 and 26 respectively positioned adjacent respective right and left side edges of the planar support web 24, wherein each of the web openings 25 and 26 are spaced apart the equal predetermined spacing to receive an externally threaded rod 31 through each pair of openings defined by a spaced circular aperture 23 and an associated underlying web opening, as illustrated in FIG. 4.

Figure 2:
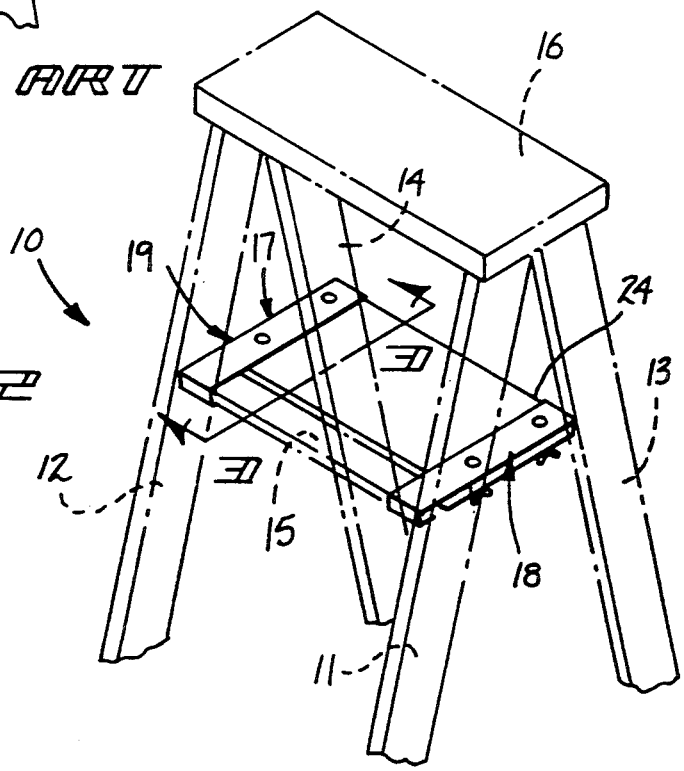
FIG. 2 is an isometric illustration of the instant invention.
Figure 3:
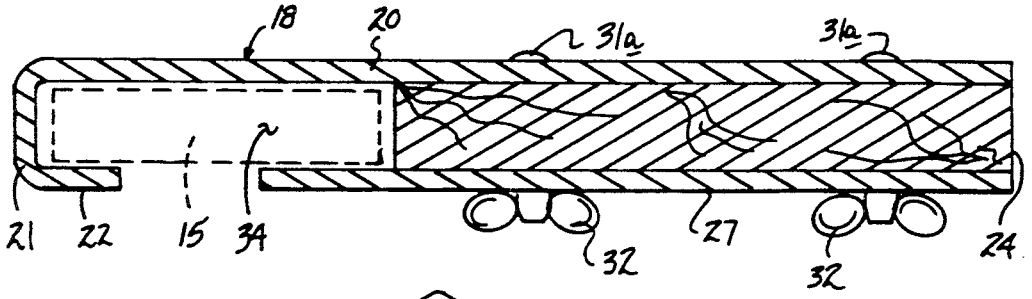
FIG. 3 is an orthographic side view, taken along the line 3—3 of FIG. 2 in the direction indicated by the arrows.

Respective right and left bottom plates 27 and 28 are mounted to the planar support web 24 to a bottom surface thereof spaced from and parallel each respective "J" shaped top support member 18 and 19, wherein each of the right and left bottom plates 27 and 28 include a plurality of respective slots defined by spaced right elongate slots 29 and spaced left elongate slots 30. The spaced right elongate slots 29 are positioned underlying the respective right support web openings 25, with the spaced left elongate slots 30 positioned below the left support web openings 26 to receive a lower terminal end of each of the threaded rods 31. Each threaded rod 31 includes a threaded rod enlarged head member 31*a* defined by a further diameter greater than a predetermined diameter of the circular apertures 23 to maintain each of the threaded rods relative to the assembly. An internally threaded fastener 32 is threadedly secured to each threaded rod below a respective slot of the spaced elongate slots 29 and 30 to permit loosening of each of the bottom plates 27 and 28 to permit each bottom plate to reciprocate from a first extended position, wherein a forward edge of each of the bottom plates 27 and 28 extends below a portion of the associated ladder step 15 to a second position, wherein each of the right and left bottom plates 27 and 28 are positioned in orientation, wherein each bottom plate forward edge is positioned below the ladder step 15. In this manner when the bottom plates are retracted to the second position, the ladder step 15 may be removed relative to the step cavity 34 defined within each "J" shaped top support member, the associated support web 24, and an associated bottom plate. When the bottom plates 27 and 28 are in the first position, such as illustrated in FIG. 3, the associated ladder step 15 is captured within the step cavity 13, whereas upon retraction of the bottom plates to a second position, the ladder step 15 may be removed relative to the cavity for permitting repositioning of the extension assembly in orientation one hundred eighty degrees rotated relative to the configuration, as illustrated in FIG. 2, to provide an extending orientation of the planar support web 24 exteriorly of the associated ladder step 15, if desired. Alternatively, the extension assembly 17 may be positioned as illustrated, wherein the extended platform is directed between the forward and rear ladder legs for use as a support platform.

Figure 7:
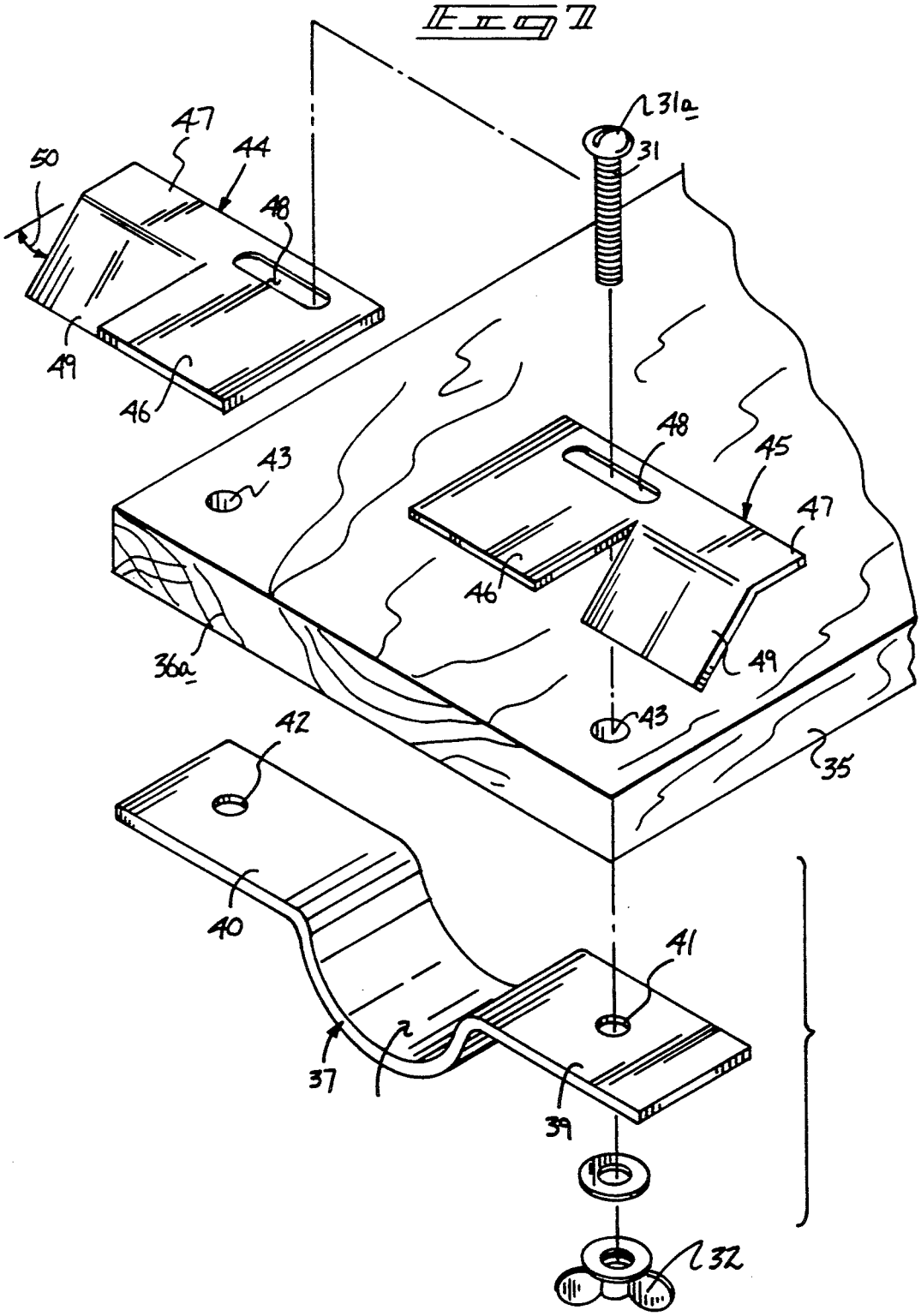
FIG. 7 is an isometric exploded illustration of the modification of the instant invention.

FIGS. 5–7 illustrate a modified ladder extension step apparatus 10*a* for use with ladders utilizing cylindrical step members 13 arranged orthogonally at equally spaced intervals between the forward right and left ladder legs 11 and 12. It should be noted that the right and left ladder legs 11 and 12 are each defined by a predetermined width. A step plate 35 is defined by a predetermined length equal to a predetermined length between the right and left ladder legs 11 and 12, and include respective right and left step plate side edges 36 and 36*a* respectively. A "U" shaped bottom plate 37 is mounted to a bottom surface of the step plate 35 adjacent the right and left side edges 36 and 36*a*, and formed with a central concave cavity 38, wherein the concave cavity 38 of each "U" shaped bottom plate 37 is in a coaxially aligned relationship relative to one another, and includes respective forward and rear leg wings 39 and 40 that are coplanar and aligned relative to one another and are formed with forward and rear leg wing apertures 41 and 42 respectively and spaced apart a predetermined distance. A plurality of step plate apertures 43 are directed through the step plate 35 adjacent the right and left side edges to position a leg wing aperture in alignment with an associated step plate aperture. A plurality of mounting brackets defined by a respective forward and rear mounting bracket 44 and 45 defining a pair of mounting brackets are oriented to position a pair of such mounting brackets adjacent each side edge of the step plate 35. Each of the mounting brackets 44 and 45 includes a first bracket leg 46 integrally and orthogonally mounted to a second bracket leg 47 defining an "L" shaped coplanar top surface oriented in a first plane, wherein an enclosed slot 48 is formed within each first bracket leg 46 adjacent a respective second bracket leg 47 to receive an associated fastener rod 31 therethrough. Each threaded fastener rod 31 is defined by a predetermined diameter, and includes an enlarged head 31*a* positioned above each associated slot 48 to secure each of the brackets 46 and the "U" shaped bottom plates 37 together relative to the step plate 35. Each second bracket leg 47 includes a clamping jaw flange 49 oriented in a second plane, wherein the second plane defines an acute angle relative to the first plane and wherein the clamping jaw flanges are spaces apart a distance equal to the predetermined width of each ladder leg to capture a respective ladder leg between a respective pair of the forward and rear mounting brackets 44 and 45. In this manner, a cylindrical step member 33 is positioned within the aligned "U" shaped concave cavities 38, wherein rotation of the organization is prevented by the clamping flanges 49 positioned exteriorly of and to capture a respective ladder leg 11 or 12 therebetween. It should be noted that the enclosed slots 48 are maintained a longitudinally aligned orientation relative to one another and are oriented generally parallel to a side edge of the associated step plate 35.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ladder extension step apparatus, comprising in combination, a ladder member, the ladder member including a right ladder leg spaced from and parallel a left ladder leg, the right ladder leg and left ladder leg including a plurality of ladder steps orthogonally mounted between the right and left ladder legs at an equal predetermined spacing between each ladder step, and an extension assembly removably mounted to at least one of said ladder steps, the extension assembly including a respective right "J" shaped top support members spaced from and parallel a respective left "J" shaped top support member, and each support member including a first plate web orthogonally mounted to a second plate web, wherein the second plate web is orthogonally mounted to the third plate web, wherein the third plate web is positioned below and parallel the first plate web, and wherein the first plate web is defined by a first length, and the third plate web is defined by a third length less than the first length, and the at least one ladder step is defined by a predetermined thickness, wherein the second length defined by the second plate web is substantially equal to the predetermined thickness, and including a planar support web, the planar support web including a planar support web top surface and a planar support bottom surface, and the right "J" shaped top support member and the left "J" shaped top support member are mounted to the planar support web top surface, wherein the second plate web and the third plate webs are spaced from the planar support web, and further including a right bottom plate reciprocatably mounted to the planar support web below the right "J" shaped top support member, and a left bottom plate mounted to the planar support web bottom surface below the left "J" shaped top support member, and each right and left bottom plate reciprocatable from a first position extending forwardly of the planar support web adjacent the third plate web defined by a first spacing to the retracted second position, wherein the right and left bottom plates are retracted relative to the third plate web of the respective right and left "J" shaped top support member a second spacing, wherein the second spacing is greater than the first spacing to permit removal and reinsertion of the ladders step between the right and left bottom plates and the right and left "J" shaped top support member, and the first plate web of each "J" shaped support member includes a plurality of circular apertures spaced apart the predetermined spacing, and the planar support web includes a first pair of openings positioned below the first plate web of the right "J" shaped top support plate the predetermined spacing, and the planar support web includes a further pair of openings spaced below the left "J" shaped top support plate the predetermined spacing, and the right bottom plate includes a plurality of right elongate slots and the left bottom plate includes a plurality of left elongate slots, wherein the "J" shaped top support member, the planar support webs openings, and the right elongate slots receive the first fasteners therethrough, and the left "J" shaped top support member, the further openings and the left elongate slots of the left bottom plate include further fasteners directed therethrough.

2. A ladder extension step apparatus, comprising in combination, a ladder assembly, wherein the ladder assembly includes a right ladder leg spaced from and parallel a left ladder leg, the right ladder leg and the left ladder leg include a plurality of equally spaced cylindrical step members orthogonally mounted between the right and left ladder legs, and the right and left ladder legs are each defined by a respective right and left ladder leg interior surface, wherein the right and left ladder legs interior surfaces are in confronting relationship relative to one another and are defined by an equal predetermined width, and each cylindrical step member is defined by a predetermined length, and an extension assembly mounted to at least one of said cylindrical step members, and the extension assembly including a step plate, the step plate defined by a predetermined length equal to the predetermined length of the at least one cylindrical step member, and the step plate including a step plate bottom surface, a step plate top surface, a step plate right side edge, and a step plate left side edge, and wherein the extension assembly includes a right "U" shaped bottom plate spaced from and parallel a left "U" shaped bottom plate, wherein the right and left "U" shaped bottom plates are spaced apart a predetermined spacing equal to the predetermined length of the cylindrical step member, and each "U" shaped bottom plate includes a central concave cavity, each concave cavity is coaxially aligned relative to one another, and each central concave cavity includes a forward leg wing and a rear leg wing, the forward and rear leg wings are arranged in a coplanar relationship and are longitudinally aligned relative to one another, and the forward leg wing includes a forward leg wing aperture, and the rear leg wing includes a rear leg wing aperture, wherein the forward leg wing aperture and the rear leg wing aperture are spaced apart a predetermined distance, and the step plate includes a first pair of step plate apertures directed through the step plate adjacent the left side edge a distance equal to the predetermined distance, and the step plate includes a further pair of apertures directed through the step plate adjacent the right side edge spaced apart the predetermined distance, wherein the further pair of apertures is positioned over the forward leg wing aperture and the rear leg wing aperture of the right "U" shaped bottom plate, and the apertures adjacent the left side edge are positioned over the forward leg wing aperture and the rear leg wing aperture of the left "U" shaped bottom plate, and wherein the extension assembly includes a plurality of left bracket means secured to the step plate and to the left "U" shaped bottom plate for securement of the left ladder leg between the plurality of left bracket means, and wherein the extension assembly further includes a plurality of right bracket means mounted to the step plate above the right "U" shaped bottom plate for securement of the right ladder leg between the plurality of right bracket means.

3. An apparatus as set forth in claim 2 wherein each bracket means includes a first bracket leg orthogonally and integrally mounted to a second bracket leg when the first bracket leg and second bracket leg are arranged in a first plane, and the second bracket leg includes a clamping jaw flange mounted integrally and fixedly to the second bracket leg defining a second plane, wherein the second plane defines an acute angle between the second plane and the first plane, and the first bracket leg includes an elongate slot, and each elongate slot of the right bracket means is in an aligned relationship, and each elongate slot of the left bracket means are in an aligned relationship to permit adjustment of the plurality of left bracket means and the plurality of right bracket means to the step plate to permit securement of the respective right ladder leg and left ladder leg within the respective plurality of left bracket means and right bracket means respectively.

* * * * *